US009777962B2

(12) United States Patent
Mastroianni et al.

(10) Patent No.: US 9,777,962 B2
(45) Date of Patent: Oct. 3, 2017

(54) COIL SUPPORT HAVING CONDENSATE MANAGEMENT FUNCTIONALITY

(71) Applicant: TRANE INTERNATIONAL INC., Piscataway, NJ (US)

(72) Inventors: Scott Mastroianni, Atlanta, GA (US); Chris Menhennett, Lynn Haven, FL (US); Ralph Briggs, Lynn Haven, FL (US); Joshua Dale Stephens, Panama City, FL (US); Derick Pryor, Panama City, FL (US); Frank Graff, Panama City Beach, FL (US)

(73) Assignee: TRANE INTERNATIONAL INC., Davidson, NC (US)

( * ) Notice: Subject to any disclaimer, the term of this patent is extended or adjusted under 35 U.S.C. 154(b) by 247 days.

(21) Appl. No.: 14/687,596

(22) Filed: Apr. 15, 2015

(65) Prior Publication Data

US 2015/0292790 A1 Oct. 15, 2015

Related U.S. Application Data

(60) Provisional application No. 61/979,770, filed on Apr. 15, 2014.

(51) Int. Cl.

| | |
|---|---|
| ***F28F 9/00*** | (2006.01) |
| ***F28D 1/047*** | (2006.01) |
| ***F24F 13/22*** | (2006.01) |
| ***F24F 13/30*** | (2006.01) |
| ***F28F 9/013*** | (2006.01) |
| ***F28F 9/02*** | (2006.01) |
| ***F28F 17/00*** | (2006.01) |

(52) U.S. Cl.

CPC ..... *F28D 1/0476* (2013.01); *F24F 13/222* (2013.01); *F24F 13/30* (2013.01); *F28F 9/001* (2013.01); *F28F 9/013* (2013.01); *F28F 9/0243* (2013.01); *F28F 17/005* (2013.01); *F28F 2275/08* (2013.01)

(58) Field of Classification Search

CPC ..... F28D 1/0476; F24F 13/222; F24F 13/30; F28F 9/001; F28F 9/013; F28F 9/0243; F28F 17/005; F28F 2275/08

USPC ..... 165/67, 68

See application file for complete search history.

(56) References Cited

U.S. PATENT DOCUMENTS

| | | | | |
|---|---|---|---|---|
| 3,448,795 | A * | 6/1969 | McNabney | F24D 19/04 165/55 |
| 3,934,645 | A * | 1/1976 | Butts | F28F 9/0138 165/134.1 |
| 4,353,219 | A * | 10/1982 | Patrick, Jr. | F24F 13/30 62/183 |
| 4,410,033 | A * | 10/1983 | Wawro | F24F 1/0007 165/137 |
| 8,555,669 | B1 | 10/2013 | Leblanc et al. | |
| 2007/0169494 | A1 * | 7/2007 | Rembold | F25D 21/14 62/285 |

* cited by examiner

*Primary Examiner* — Justin Jonaitis

(74) *Attorney, Agent, or Firm* — Hamre, Schumann, Mueller & Larson, P.C.

(57) ABSTRACT

The embodiments described herein are directed to a coil support and a method of using the coil support for condensate management. The coil support generally functions to provide support for evaporator and/or condenser coils and facilitate the drainage of condensate away from coil headers.

17 Claims, 10 Drawing Sheets

SECTION
10-10

COIL SUPPORT HAVING CONDENSATE MANAGEMENT FUNCTIONALITY

FIELD

The embodiments disclosed herein relate generally to a component within a coil mounting assembly and in particular, a component that supports an evaporator and/or condenser coil and has condensate management functionality.

BACKGROUND

In general, an evaporator or condenser coil of a heating, ventilation, and air conditioning unit is secured in place via a sheet metal frame. The frame is screwed into mounting brackets that are incorporated into the coil assembly. Condensate is free to drip off the coil and into a drain pan over which the coil is suspended, and then out of the unit. Improvements in the coil assembly may be made.

SUMMARY

The embodiments described herein are directed to a coil support and a method of using the coil support for condensate management. The coil support generally functions to provide support for evaporator and/or condenser coils and facilitate the drainage of condensate away from coil headers and/or coils.

In general, the coil support can be used in a unit within a heating, ventilation, and air conditioning system, e.g., a condensing unit, air handler, or packaged unit. In some examples, the condensing unit, air handler, or packaged unit can include an evaporator and/or condenser coil assembly that includes a support frame, a side plate, a base plate and a coil slab through which refrigerant carrying coils, e.g., microchannel coils, extend across the width or length of the evaporator and/or condenser coil assembly.

In some examples, a coil slab is folded so as to form two rows of microchannel coils. In this instance, the two rows are interconnected by a return bend. In some examples, a coil header is provided at each end of the slab. In the instance where the slab is folded to form two rows, the two headers are provided in tandem on the same end of the folded slab that is opposite of the end of the return bend. In some examples, the headers are structurally robust such that they are able to support the weight of the coils.

In some embodiments, the coil support can be incorporated as part of the evaporator and/or condenser coil assembly. In some instances, the coil support is attached to the support frame and/or the base plate. In some instance, the coil support includes mounting features to secure the coil support to the support frame and/or the base plate. In some instances, the coil support is incorporated as part of the assembly so as to provide support for one or more of the coil slabs via the coil headers. In some instances, the coil support is configured so as to control the spacing between the coil headers where two or more coil headers are present and/or to control the spacing between the rows of the microchannel coils where two or more rows of the microchannel coils are present. In some instances, the coil support is generally configured to facilitate the drainage of condensate away from the coil headers.

In one embodiment, the coil support includes a base having a principal surface and is elongated along a longitudinal axis from a first end to a second end. In some examples, the length from the first end to the second end is about the length of the coil headers or greater.

The base has a lateral axis across the surface that extends from a third end to a fourth end. In some examples, the width from the third end to the fourth end is greater than the distance of the widths of the coil headers.

In some examples, the base has one or more sidewalls at one or more edges of the base that extend outwardly from the principal surface of the base. In some examples, the sidewalls extend vertically away from the principal surface of the base. In some examples, the base is generally rectangular in shape and has four edges, and the sidewalls extend vertically away from the principal surface of the base along at least one of the edges of the base. In some examples, the sidewalls extend vertically away from the principal surface of the base along three of the four edges of the base so as to generally form or resemble a rectangular cuboid like shape. The sidewalls generally surround the coil headers and function to contain the condensate. It is to be realized, however, that the base and/or the sidewalls can form any shape that is suitable for surrounding and/or providing support for one or more of the coil headers.

In some instances, the coil support further includes one or more support features that are provided on the base. In some examples, the support feature is fixedly attached to the principal surface and/or one or more of the sidewalls of the base. In some examples, the coil support is formed from one mold such that the support features are an integrated part of the coil support.

In some examples, one or more of the support features is configured to provide support for one or more coil headers. In some examples, each of the support features is configured to provide support for at least a portion of one of the coil headers. In some examples, each of the support features includes one or more shaped features, where each of the shaped features has a cross-sectional shape as viewed in side view that generally follows at least a part of an outline of a side cross-sectional view of each of the coil headers.

In some examples, the support feature resembles a crescent like feature that is configured to hold a coil header. In some instances, a cross-sectional shape as viewed in side view of each of the coil headers is circular, and the crescent feature has a cross-sectional shape as viewed in side view that is crescent like shaped or arcuate so as to generally follow at least a part of the outline of the coil header.

In some examples, each of the shaped features has a shape that is similar or different to one another, for example, where the coil headers has a similar shape to one another. In some examples, the shaped features are placed in tandem so as to provide support for the coil headers that are provided in tandem.

In some instances, the support features include a center ledge between each of the shaped features. In some examples, the center ledge is dimensioned to allow condensate to flow between each of the shaped features. In some examples, the center ledge is dimensioned so as to provide a predetermined amount of space between the coil headers and thereby provide a certain amount of space between the rows of the microchannel coils. In some examples, the rows of the microchannel coils are spaced so as to allow condensate to flow between the rows of the coils.

In some instances, the support feature is an insert that can be removably attached to the principal surface of the base. In some instances, each insert can be configured to support one or more coil headers.

In some instances, the support feature includes one or more side ledges between the shaped feature and the sidewall. In some examples, each of the side ledges is dimensioned to allow condensate to flow between the shaped feature and the sidewall.

In some examples, the coil support further includes one or more openings. In some instances, the one or more openings are configured to drain a condensate that drips off the coils and accumulates within the coil support. In some examples, one or more openings are provided on the principal surface of the base and/or one or more sidewalls.

In some instances, the number of openings and/or the size of the openings are configured so as to prevent clogging. In one example, the openings extend from the principal surface of the base up along a portion of one or more of the sidewalls.

In some embodiments, the coil support is configured to manage condensate coming off of the coils. The term "configured to manage condensate" is explained as follows.

In general, the coils are oriented vertically in the condenser coil assembly. In some examples, the condenser coil assembly is angled relative to the direction of insertion. During use of the evaporator and/or condenser coil assembly, the condensate tends to run down along the edges of the coils on the surfaces of the coil slabs. The condensate then drips along the outer radius of the coil header and generally accumulates around the coil header. The coil support being "configured to manage the condensate" means that the coil support is configured to facilitate the drainage of the condensate away from the coil headers during use so as to, for example, prevent the coils from being submerged in the otherwise accumulating condensate.

In some examples, the coil support is secured to the support frame and/or the bottom plate via the mounting features. In some examples, the mounting features are screw holes, and the coil support is secured to the support frame via screws that are screwed through the screw holes. In some examples, the coil support is dimensioned and/or is made of material so as to mitigate or prevent galvanic corrosion between the screws, the support frame and the coil. In some examples, the coil support is made of aluminum.

In one embodiment, the disclosed method involves managing a condensate using the disclosed coil support in a heating, ventilation and air conditioning system. The method involves draining condensate out of the coil support at a rate sufficient to prevent clogging of the openings and/or immersion of the coils in the condensate for an extended period of time.

BRIEF DESCRIPTION OF THE DRAWINGS

Referring now to the drawings in which like reference numbers represent corresponding parts throughout.

DETAILED DESCRIPTION

The embodiments described herein are directed to a coil support and a method of using the coil support for condensate management. In some examples, the coil support is provided as part of an evaporator and/or condenser coil assembly. In some examples, the evaporator or condenser coil assembly can be included in a packaged unit. In some examples, the packaged unit can be suitable for use as a component of a heating, ventilation, and air conditioning system, e.g., used on a stationary or mobile structure.

In general, the coil support functions to provide support for evaporator and/or condenser coils and to facilitate the drainage of condensate away from coil headers.

Figure 1:
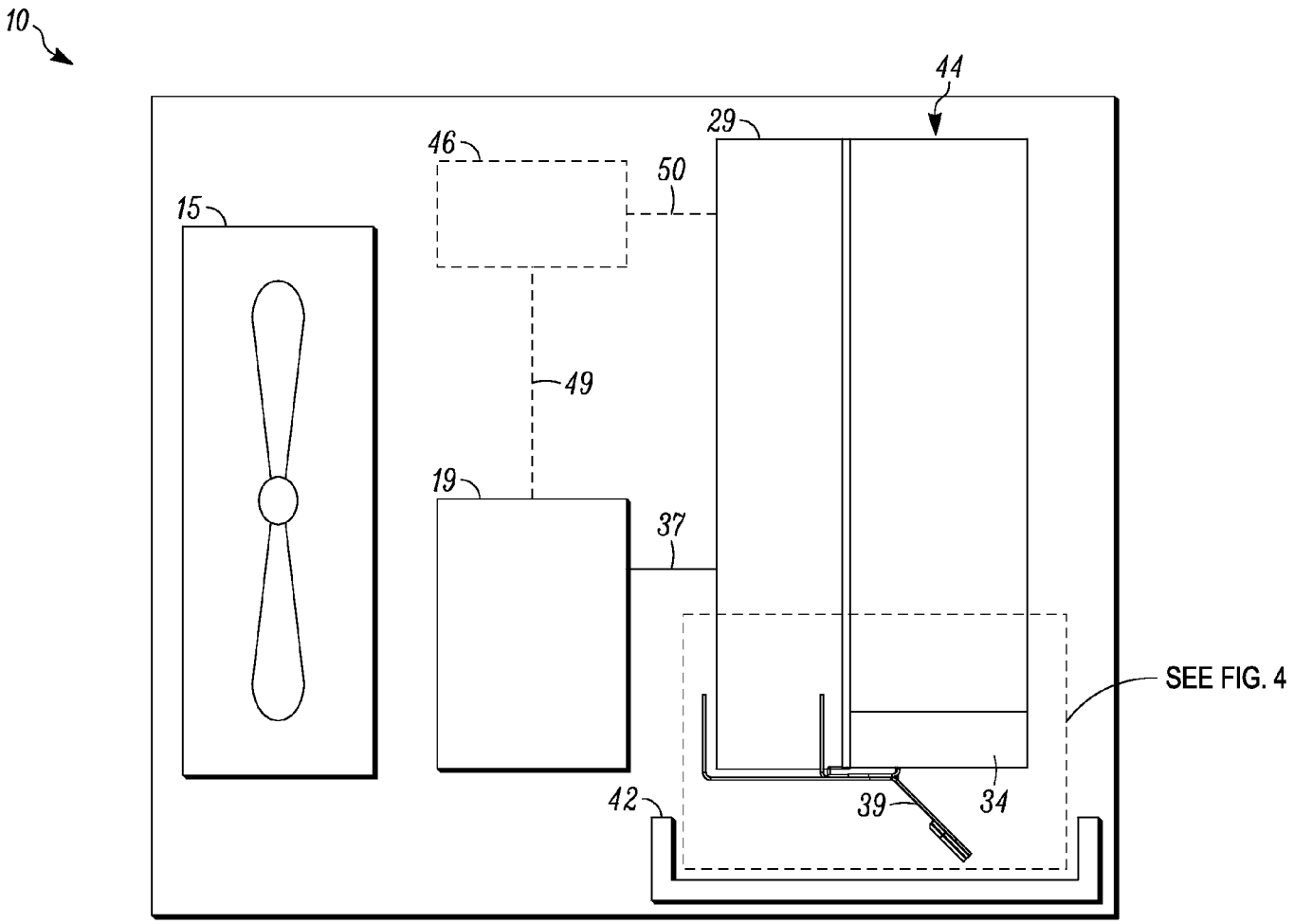
FIG. 1 is a schematic illustration of a side view of a packaged unit that includes the disclosed coil support, according to one embodiment.

FIG. 1 shows one example of a packaged unit 10 in which the disclosed coil support can be utilized. The condensing unit 10 includes a fan 15, a compressor 19 and an evaporator and/or condenser coil assembly 44.

In general, the compressor 19 is suitable for compressing a refrigerant. The compression of the refrigerant results in refrigerant being heated. The heated refrigerant then is sent through the condenser coil assembly 44 via a high pressure line 37 where the heat is dissipated. The fan 15 generally functions to discharge air that is passed through the evaporator and/or condenser coil assembly 44. The compressor 19 utilized can be any type of compressor suitable for use in a heating, ventilation, and air conditioning system. In some examples, the unit 10 can optionally include an evaporator 46. In this instance, a lower pressure line 49 can receive refrigerant from the evaporator 46, which passes to the compressor 19. The evaporator 46 in some embodiments may receive refrigerant from the coil assembly 44 through the line 50.

In some examples, the evaporator and/or condenser coil assembly 44 is vertically disposed within the unit 10 as show in FIG. 1. Referring to FIGS. 1-5, the condenser coil assembly 44 includes a support frame 29, a base plate 39, a side plate 30, a coil 58 and a coil support 34.

In some examples, the coil 58 can be a coil slab. In the example shown in FIGS. 2-5, the coil 58 is a coil slab that is folded to form two rows. Details of coil 58 shown in FIGS. 2-5 are as follows.

Figure 2:
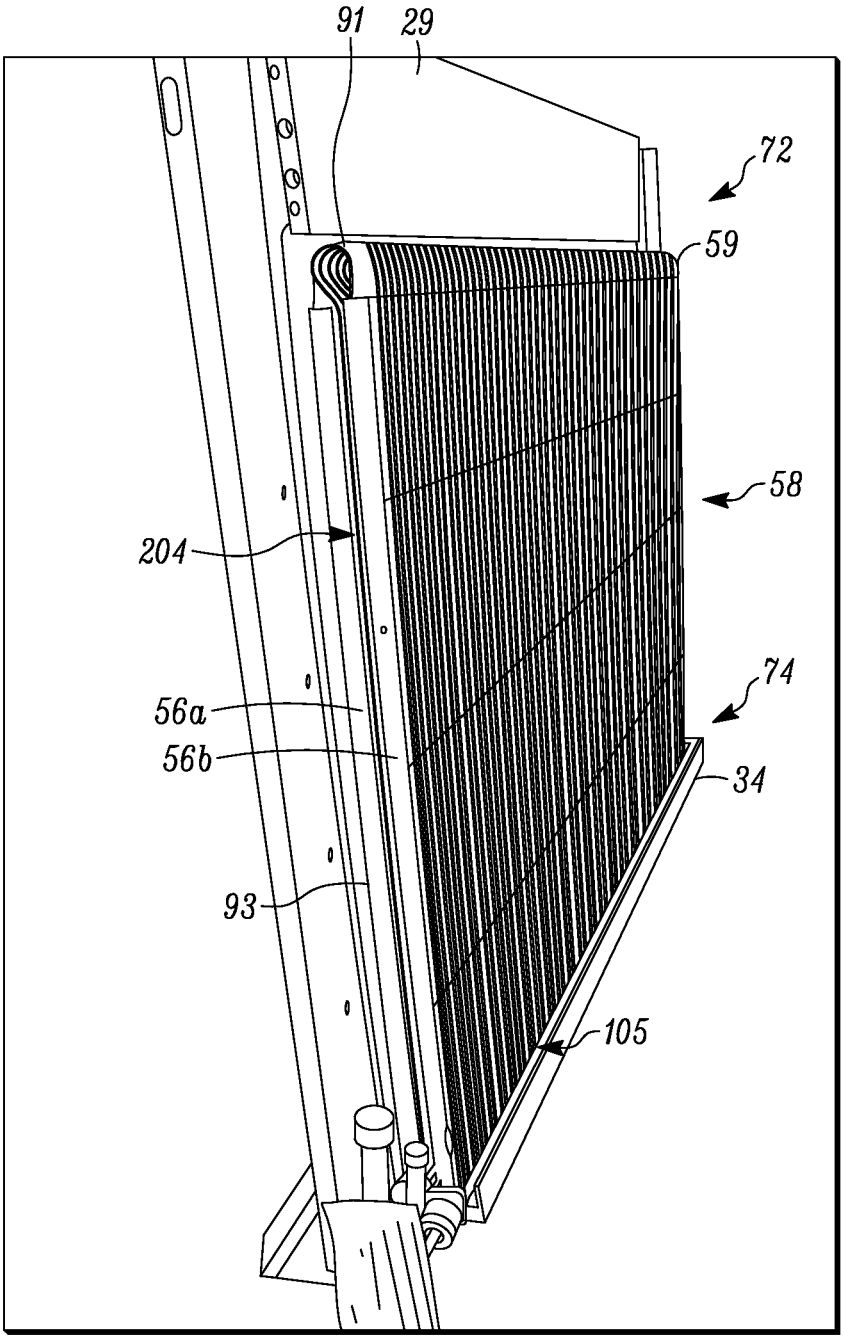
FIG. 2 is a schematic view of part of an evaporator or condenser coil assembly included in the packaged unit shown in FIG. 1, according to one embodiment.
Figure 3:
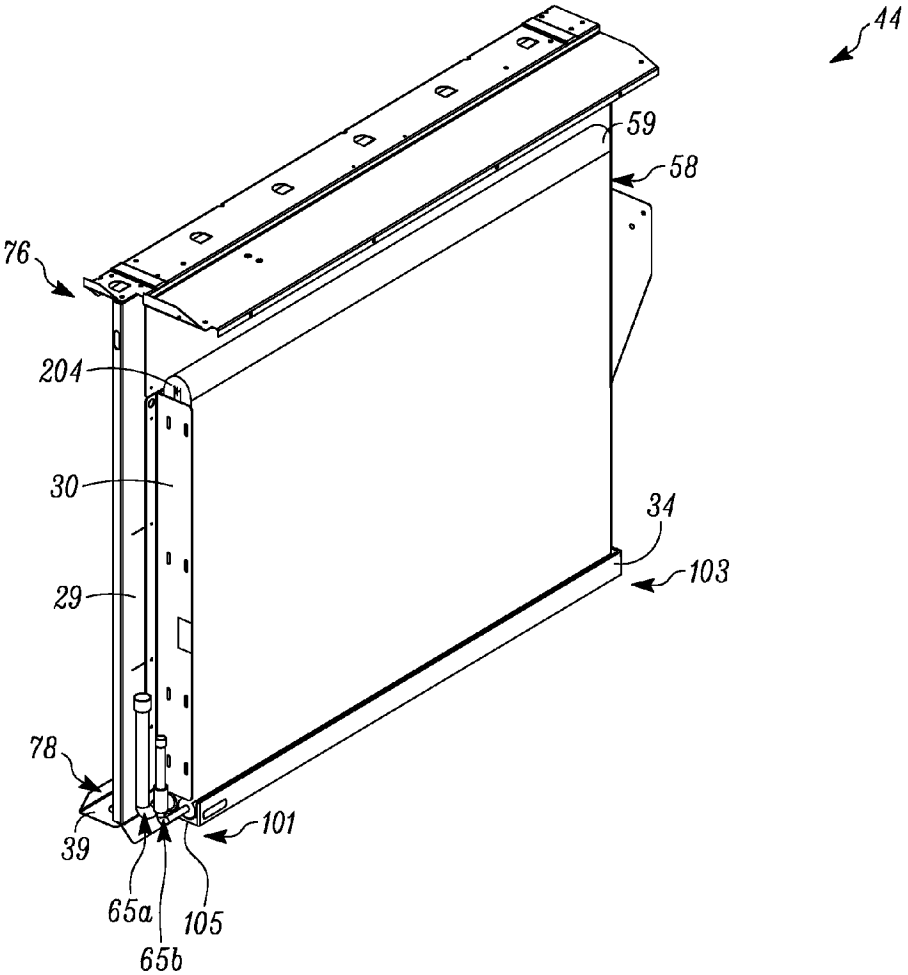
FIG. 3 is a schematic view of the evaporator or condenser coil assembly included in the packaged unit shown in FIG. 1, according to one embodiment.
Figure 4:
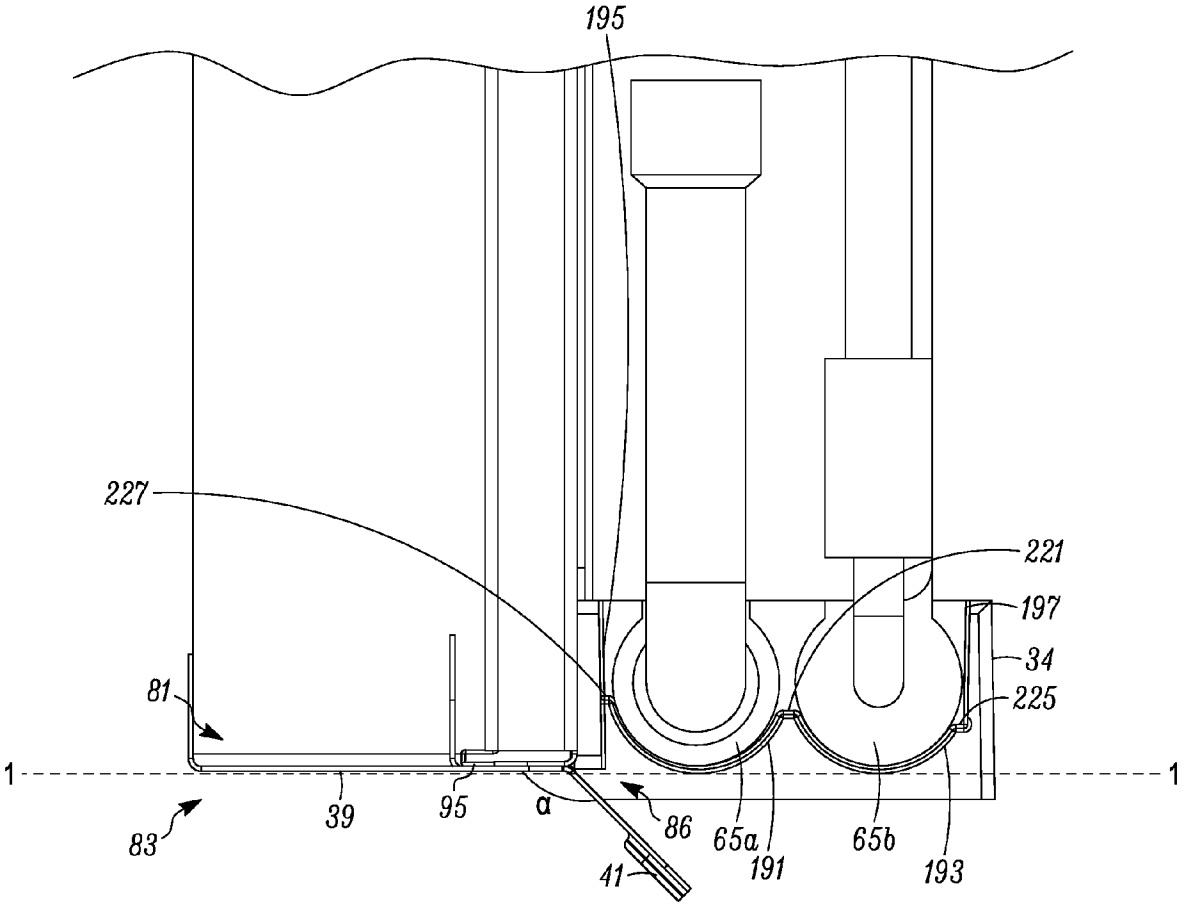
FIG. 4 is a partial side view of an evaporator or condenser coil assembly included in the packaged unit shown in FIG. 1, according to one embodiment.

Referring to FIGS. 2 and 3, the coil 58 includes microchannel coils that extend at least in part across the width of the condenser coil assembly 44. The coil 58 shown in FIGS. 2 and 3 is folded so as to form two rows 56*a*, 56*b* of microchannel coils. The two rows 56*a*, 56*b* extend lengthwise from a top end 72 to a bottom end 74 and are interconnected by a return bend 59 on the top end 72. Referring to FIGS. 3 and 4, a coil header 65*a* is formed at the bottom end 74 of the row 56*a*, and a coil header 65*b* is formed at the bottom end 74 of the row 56*b*.

Referring to FIGS. 2 and 3, the support frame 29 generally provides a frame that surrounds the side edges 93 and the top edge 91 of the coil 58 and extends from a top end 76 to a bottom end 78. A side plate 30 is attached to the coil 58 and the support frame 29. In some examples, the coil 58 is secured to the support frame 29 via the side plate 30 so that the coil 58 is not in contact with the support frame 29. In some examples, the support frame 29 is made of steel, and the coil 58 is made of aluminum. In this example, the configuration where the coil 58 is supported by the support frame 29 without being in contact with the support frame 29 avoids unwanted contact between the steel material and the aluminum material.

Referring to FIGS. 3 and 4, the base plate 39 is provided at the bottom end 78 of the support frame 29. The base plate 39 has a principal surface 81 that extends from a first end 83 to a second end 86 along a horizontal axis 1-1. A bottom edge 95 of the support frame 29 is provided on the principal surface 81 of the base plate 39. The base plate 39 includes a lip 41 that extends from the principal surface 81. In some examples, the lip 41 extends at an angle a relative to the horizontal axis 1-1. The angle a can be any angle suitable for directing condensate flowing from the coil support 34 to the receiving structure 42 (see FIG. 1) that is provided below the coil support 34.

Figure 5:
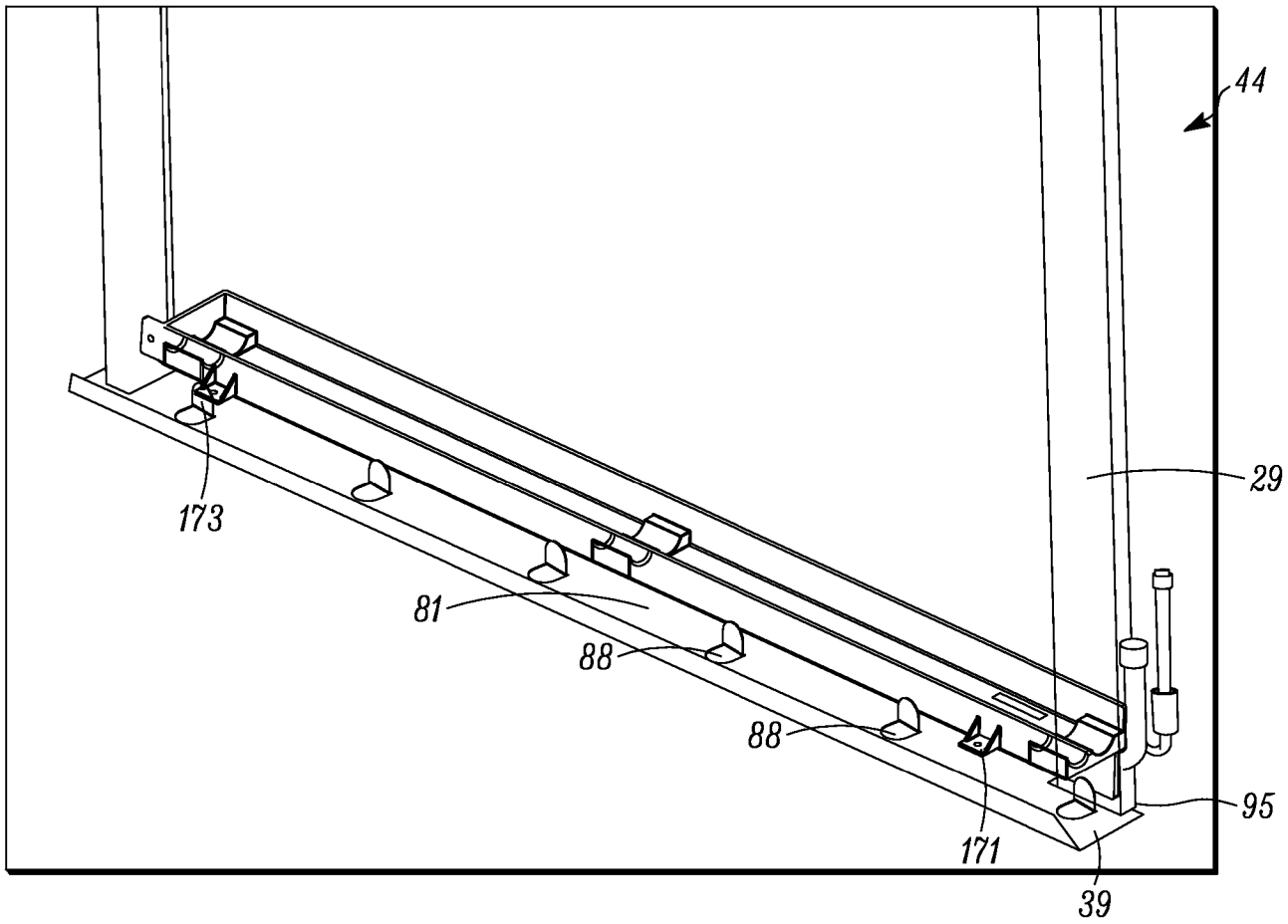
FIG. 5 is a partial back view of the evaporator or condenser coil assembly included in the packaged unit shown in FIG. 1, according to one embodiment.

Referring to FIG. 5, the base plate 39 can include one or more tabs 88 that extend vertically from the principal surface 81 of the base plate 39. The tabs 88 generally function as placement guides for the coil filters.

FIGS. 6-10 illustrate details of the coil support 34. In general, the coil support 34 is configured to provide support for the coil 58 for example via the coil headers 65*a*, 65*b*. That is, the coil headers 65*a*, 65*b* are structurally robust such that they are able to support the weight of the coil 58. Referring to FIGS. 2-4, the coil headers 65*a*, 65*b* generally have a tube structure and extend from a first end 101 to a second end 103 along a bottom edge 105 of the coil 58. The coil support 34 can provide support for the coil 58 by including features that allow the coil headers 65*a*, 65*b* to be supported on these features, which will be described in detail below.

Referring back to FIGS. 6-10, the coil support 34 includes a base 108 having a principal surface 112 and a first edge 115, a second edge 117, a third edge 121 and a fourth edge 123. The base 108 is elongated along a longitudinal axis 2-2 from a first end 124 to a second end 126. In some embodiments, the second end 126 has an open structure 134, and is open relative to the first end 124, which may have in some embodiments the sidewall 131. In some examples, the length from the first end 124 to the second end 126 of the base 108 is about the length of the coil headers 65*a*, 65*b* or greater. The base 108 has a lateral axis A-A across the principal surface 112 that extends from a third end 129 to a fourth end 132. In some examples, the width from the third end 129 to the fourth end 132 is about the widths of the coil headers 65*a*, 65*b* or greater.

Figure 8:
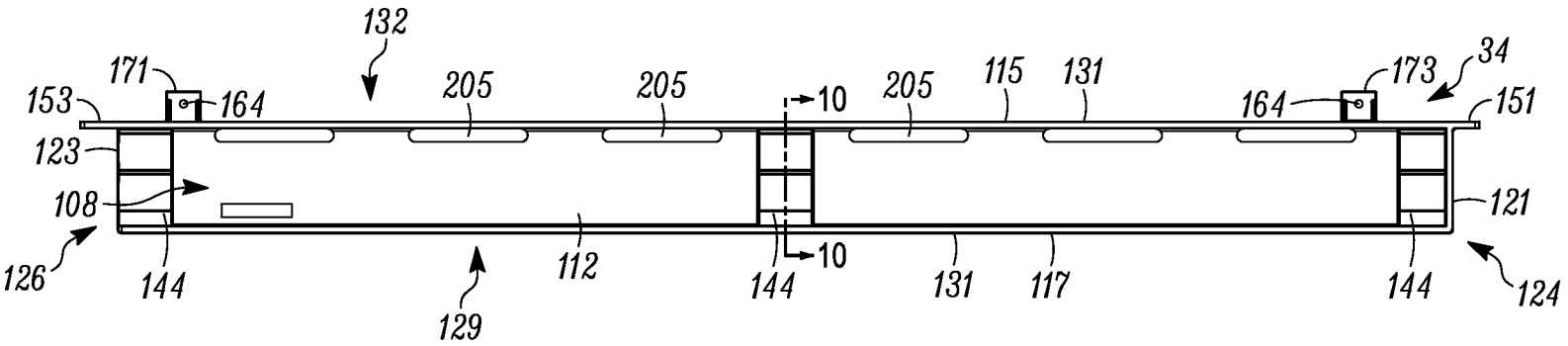
FIG. 8 is a top view of the coil support shown in FIGS. 6 and 7, according to one embodiment.

The base 108 includes sidewalls 131 that generally extend vertically away from the principal surface 112 of the base 108. Referring to FIG. 8, the sidewalls 131 are provided along the first edge 115, the second edge 117 and the third edge 121 so that the base generally forms a rectangular cuboid shape. The sidewalls 131 are generally configured to surround the coil headers 65*a*, 65*b* and in some examples, the base 108 and the sidewalls 131 generally function to contain the condensate that drips off the coil headers 65*a*, 65*b*. It is to be realized, however, that the base 108 and/or the sidewalls 131 can form any shape that is suitable for surrounding and/or providing support for one or more of the coil headers 65*a*, 65*b*.

Referring to FIGS. 6-9, the sidewall 131 along the edge 115 of the base 108 has a first flange 151 that extends away in the direction of the axis 2-2 away from the third edge 121, and a second flange 153 that extends away in the direction of the axis 2-2 away from the fourth edge 123. Each of the first flange 151 and the second flange 153 includes a mounting feature 164. In the example shown in the figures, the first and second flanges 151, 153 are shaped differently from one another. However, it is to be realized that the flanges 151, 153 can be any shape that is suitable for mounting the coil support 34 within a coil assembly. In some examples, the mounting feature 164 is a screw hole.

Referring to FIGS. 6-9, the sidewall 131 along the edge 115 of the base 108 has a front surface 178 that faces inwardly towards an inside 181 of the coil support 34 and a back surface 176 that faces outwardly towards an outside 184 of the coil support 34. On the back surface 176 of the sidewall 131 along the edge 115 are tabs 171, 173 that extend in a direction in the direction of the axis A-A away from the back surface 176. Each of the tabs 171, 173 include mounting features 164. In some examples, each of the mounting features 164 is a screw hole.

In some instances, the coil support 34 includes one or more support features 144 that are provided on the base 108. In some examples, the support features 144 are attached to the principal surface 112 and/or one or more of the sidewalls 131. In some examples, the coil support 34 is formed from one mold such that the support features 144 are an integrated part of the coil support 34.

In some examples, the support features 144 are fixedly attached to the principal surface 112 and/or one or more of the sidewalls 131. In some examples, the support features 144 are removable.

In some examples, one or more of the support features 144 is generally configured to provide support for one or more coil headers 65*a*, 65*b*. In some examples, each of the support features 144 is configured to provide support for at least a portion of one of the coil headers 65*a*, 65*b*. In some examples, each of the support features 144 includes one or more shaped features 191, 193, where each of the shaped features 191, 193 (see FIGS. 4 and 10) has a cross-sectional shape as viewed in side view that generally follows at least a portion of an outline of a side cross-sectional view of each of the coil headers 65*a*, 65*b*.

Figure 10:
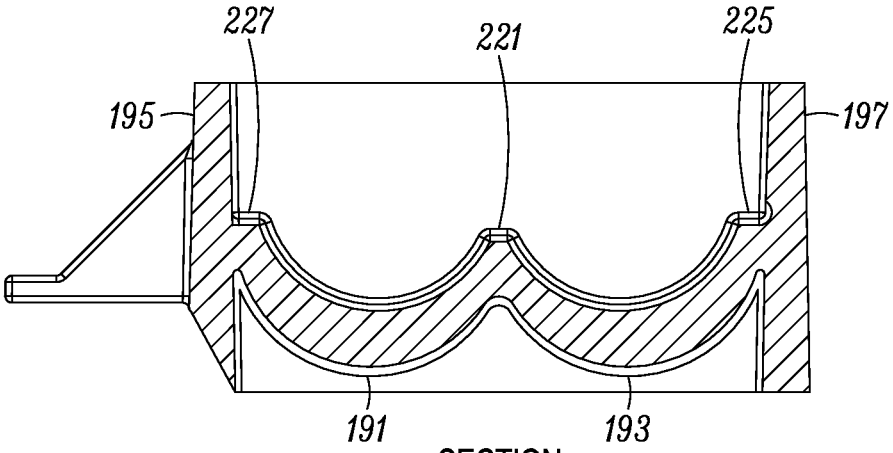
FIG. 10 is a side view of a support feature included in the coil support shown in FIGS. 6 and 7, according to one embodiment.

Referring to FIGS. 4 and 10, in some examples, each of the support features 144 includes sidewalls 195, 197 and the shaped features 191, 193 are provided between the sidewalls 195, 197. In some examples, the shaped features resemble crescent like or arcuate features 191, 193. In some examples, each of the crescent features 191, 193 has a cross-sectional shape that resembles a crescent like shape and is generally configured to nest each of the coil headers 65*a*, 65*b* as illustrated in FIG. 4.

In some examples, each of the shaped features 191, 193 has a shape that is similar to one another. In some examples, the shaped features 191, 193 are placed in tandem so as to provide support for the coil headers 65*a*, 65*b* that are also provided in tandem. In the example illustrated in FIGS. 4 and 10 where the shaped features 191, 193 are crescent features, the cross-sectional view as viewed in side view resembles a form of a "W". However, it is to be realized that the number and shapes of the shaped features can be any number and/or shapes that are suitable for supporting the coil headers. In some examples, each of the shaped features 191, 193 has a shape that is different from one another.

Referring to FIGS. 4 and 10, the support feature 144 includes a center ledge 221 between each of the shaped features 191, 193. In some examples, the center ledge 221 is dimensioned to allow condensate to flow between each of the shaped features 191, 193. In some examples, the center ledge 221 is dimensioned so as to provide a predetermined amount of space (see e.g. 204) between the coil headers 65*a*, 65*b* and thereby provide a certain amount of space between the rows 56*a*, 56*b* of the microchannel coils. In some examples, the rows 56*a*, 56*b* are spaced (see e.g. 204) so as to allow condensate to flow between the rows 56*a*, 56*b* of the microchannel coils.

Figure 6:
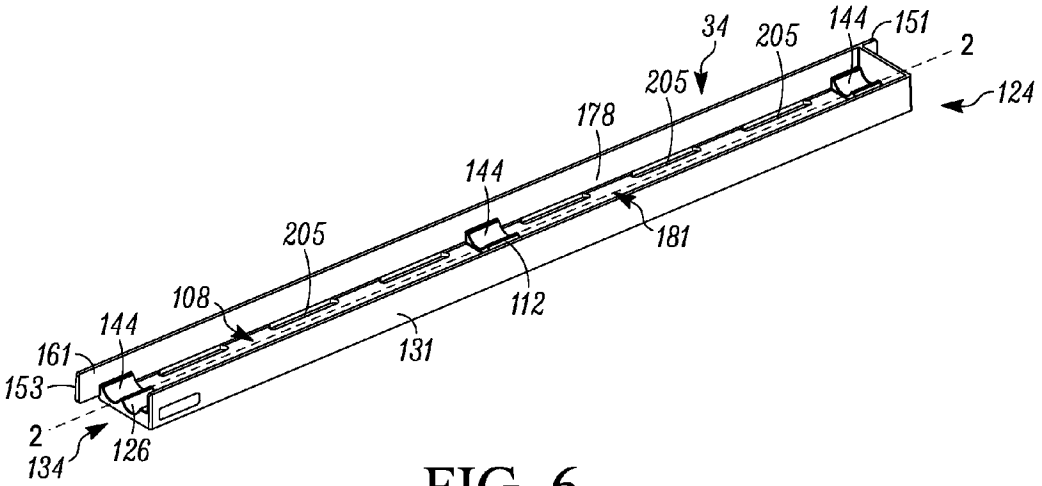
FIG. 6 is a schematic view of a coil support included in the packaged unit shown in FIG. 1, according to one embodiment.
Figure 7:
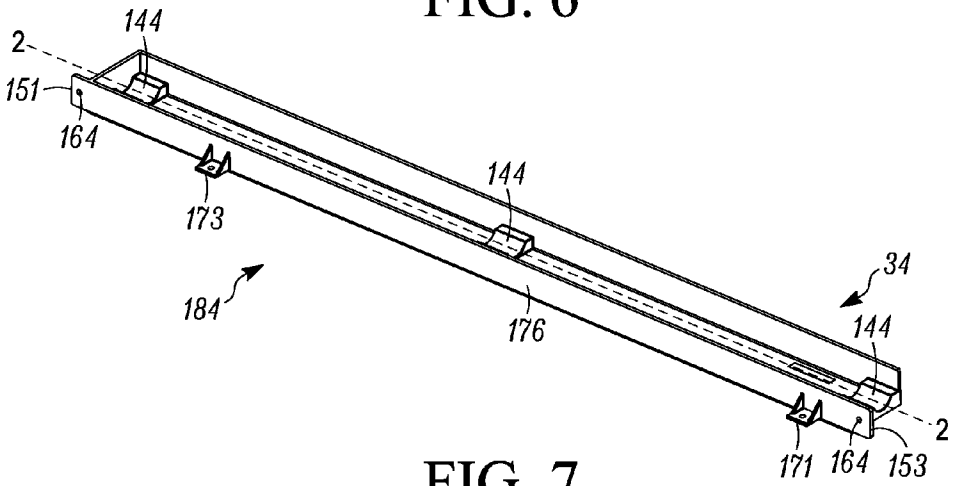
FIG. 7 is another schematic view of a coil support included in the packaged unit shown in FIG. 1, according to one embodiment.
Figure 9:
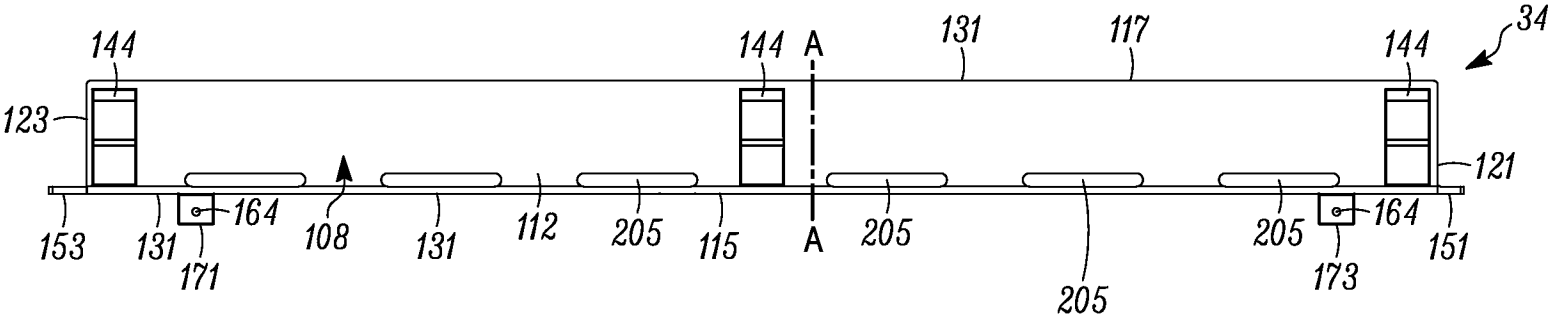
FIG. 9 is a bottom view of the coil support shown in FIGS. 6 and 7, according to one embodiment.

Referring to FIGS. 6 and 9, the support feature 144 also can include a side ledge 225 that is provided between the shaped feature 193 and the sidewall 197 and a side ledge 227 that is provided between the shaped feature 191 and the sidewall 195. In some examples, each of the side ledges 225, 227 is dimensioned to allow condensate to flow between the shaped features 191, 193 and the sidewalls 195, 197.

In some examples, the coil support 34 further includes one or more openings 205. In some instances, the one or more openings 205 are configured to drain a condensate that drips off the coil headers 65*a*, 65*b* and accumulates in the inside 181 of the coil support 34. In some examples, the openings 205 are provided on the principal surface 112 of the base 108 and/or one or more sidewalls 131.

In some examples, the openings 205 provided on the principal surface 112 of the base 108 extend from the edge 115 along at least a portion of the principal surface 112. In some examples, the openings 205 provided on the principal surface 112 of the base 108 extend from the principal surface 112 of the base 108 to at least a portion of one or more sidewalls 131.

In some instances, the number of openings 205 and/or the size of the openings 205 are configured so as to prevent clogging. In the example shown in FIGS. 6-9, six intermittent openings 205 are provided along the edge 115 of the base 108. However, it is to be realized that any number of openings suitable for drainage may be utilized.

In some embodiments, the coil support 34 is configured to manage condensate coming off of the coil headers 65*a*, 65*b* during use such that the coil support 34 facilitates the drainage of the condensate away from the coil headers 65*a*, 65*b* and/or prevent the coils 58 from being submerged in the otherwise accumulating condensate.

In some examples, the coil support 34 is secured to the support frame 29 via the mounting features 164. In some examples, the mounting features 164 are screw holes, and the coil support 34 is secured to the support frame 29 via screws that are screwed through the screw holes 164. In some examples, the coil support 34 is dimensioned and/or is made of material so as to mitigate or prevent galvanic corrosion between the screws, the support frame 29 and the coil 58. In some examples, the coil support 34 is made of the same material as that of the microchannel coils. In some examples, the coil support 34 is made of aluminum, plastic, etc.

Figure 11:
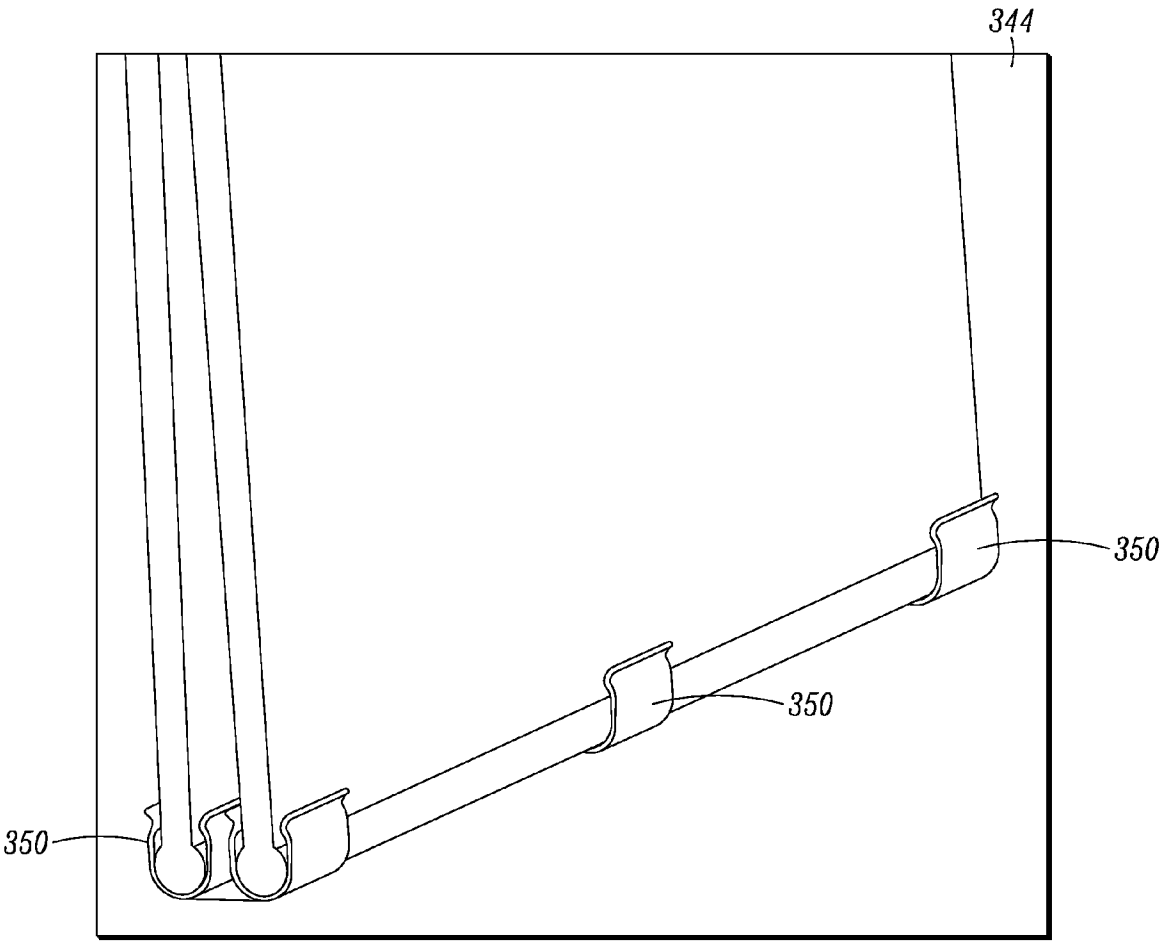
FIG. 11 is a partial perspective view of an evaporator or condenser coil, showing a coil support according to one embodiment.
Figure 12:
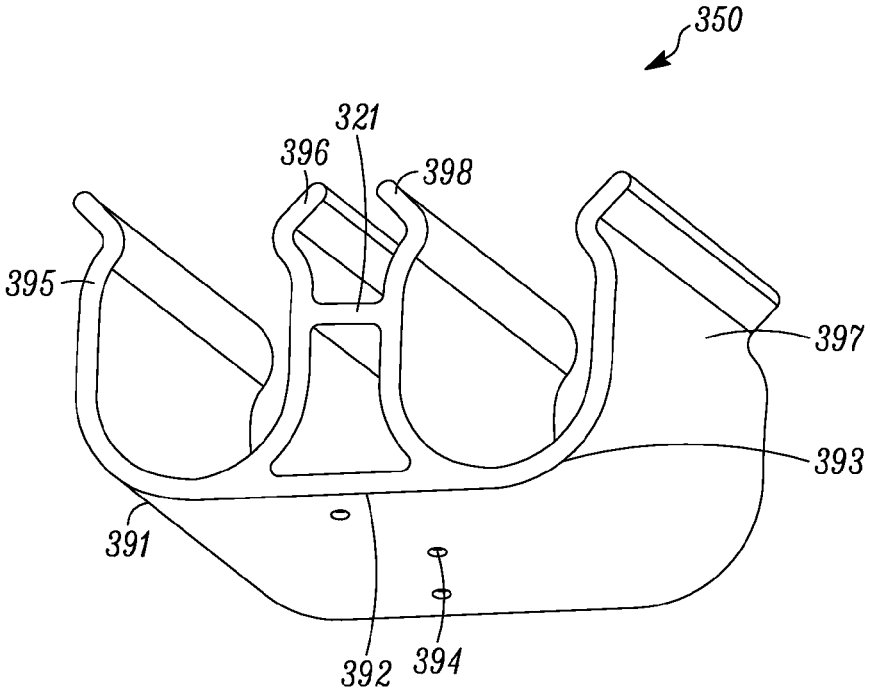
FIG. 12 is a perspective view of the coil support which may be utilized as the coil support in FIG. 11, according to one embodiment.
Figure 13:
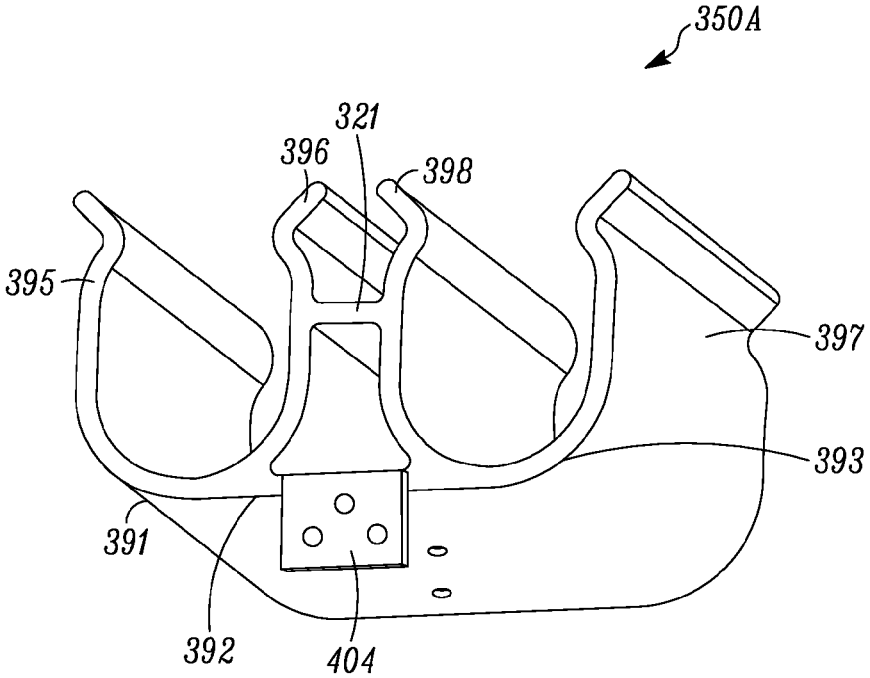
FIG. 13 is a perspective view of the coil support which may be utilized as the coil support in FIG. 11, according to one embodiment.

FIGS. 11 through 13 show another embodiment of a coil support feature 350 that is constructed as a standalone component, e.g. without being constructed as part of a frame with a base and sidewalls. The coil support 350 in some embodiments may be constructed as a clip-like component, which may be useful for assembling a coil where the header(s) are oriented somewhat upright or vertically oriented. FIG. 11 is a partial perspective view of an evaporator or condenser coil 344, showing the coil support 350. FIG. 12 is a perspective view of the coil support 350 which may be utilized as the coil support in FIG. 11, according to one embodiment. FIG. 13 is a perspective view of a coil support 350A which may be utilized as the coil support in FIG. 11, according to one embodiment.

In some instances, the coil support 350 is configured so as to control the spacing between the coil headers, such as where two or more coil headers are present and/or to control the spacing between the rows of the microchannel coils where two or more rows of the microchannel coils are present. In some instances, the coil support is generally configured to facilitate the drainage of condensate away from the coil headers.

In some examples, one or more of the support features 395, 397 of the coil support 350 is configured to provide support for one or more coil headers (e.g. 65*a*, 65*b*). In some examples, each of the support features 395, 397 is configured to provide support for at least a portion of one of the coil headers. In some examples, each of the support features 395, 397, includes one or more shaped features 391, 393, where each of the shaped features 391, 393 has a cross-sectional shape as viewed in side view that generally follows at least a part of an outline of a side cross-sectional view of each of the coil headers.

In some examples, the support features 395, 397 are configured to hold a coil header. In some instances, a cross-sectional shape as viewed in side view of each of the coil headers is circular, and the shaped features 391, 393 has a cross-sectional shape as viewed in side view that resembles a crescent like shaped or an arcuate shape so as to generally follow at least a part of the outline of the coil header.

In some examples, each of the shaped features 391, 393 has a shape that is similar or different to one another, for example, where the coil headers has a similar shape to one another. In some examples, the shaped features 391, 393, are placed in tandem so as to provide support for the coil headers that are provided in tandem.

In some instances, the support features 395, 397 include a center ledge 321 between the shaped features 391, 393. In some examples, the center ledge 321 is dimensioned to allow condensate to flow between the shaped features 391, 393 and off the coil (e.g. 344). In some examples, the center ledge 321 is dimensioned so as to provide a predetermined amount of space between the coil headers and thereby provide a certain amount of space between the rows of the microchannel coils. In some examples, the rows of the microchannel coils are spaced so as to allow condensate to flow between the rows of the coils (see e.g. FIG. 11).

Referring to FIGS. 12 and 13, in some examples, each of the support features 395, 397 includes sidewalls 396, 398 respectively, and the shaped features 391, 393 are provided between the sidewalls. In some examples, the shaped features 391, 393 resemble crescent like or arcuate features 391, 393. In some examples, each of the crescent features 391, 393 has a cross-sectional shape that resembles a crescent like shape and is generally configured to nest each of the coil headers 65*a*, 65*b* (e.g. similar to that illustrated in FIG. 4).

In some examples, one or both of the sidewalls 396, 398 for the respective support features 395, 397 may have flared ends with a catch or barb like structure, which provides the retaining structure when the support feature 395, 397 is assembled with a coil, e.g. clipped. The sidewalls 396, 398 may be suitably resilient to allow inserting a coil into the support feature 395, 397 and also suitably rigid to retain the header once assembled.

In the example illustrated in FIGS. 12 and 13 where the shaped features 391, 393 are crescent like, arcuate shaped features, the cross-sectional view as viewed in side view resemble a form of a "W", and thus may be constructed as a "W" clip. However, it is to be realized that the number and shapes of the shaped features can be any number and/or shapes that are suitable for supporting the coil headers. In some examples, each of the shaped features 391, 393 has a shape that is different from one another.

The support features 395, 397 in some embodiments include a mounting portion 392. The mounting portion 392 is configured to allow the support features 395, 397 to be assembled for example to another structure or equipment, such as a frame, sheet, plate, and the like. The mounting portion 392 can include a mount feature 394, 404 such as for example screw holes. FIG. 12 shows the mount feature 394 directly on the mounting portion 392, such as for example to allow for a bottom mount configuration or orientation, whereas FIG. 13 shows the mount feature 404 on a tab or shoulder portion, such as for example to allow for a side mount configuration or orientation.

The coil support 350 can allow for a coil assembly to rest on a sheet metal component while preventing contact between dissimilar metals. In some embodiments, the coil support may be made of a molded plastic, molded foam, or extruded metal, where one example of a material may include but is not limited to expanded polypropylene (EPP) or other moldable plastic materials.

In one embodiment, the disclosed method involves managing a condensate using the disclosed coil support in a heating, ventilation, and air conditioning system. The method involves draining condensate out of the coil support at a rate sufficient to prevent clogging of the openings and/or immersion of the coils in the condensate for an extended period of time.

Aspects

Any one of aspects 1-21 can be combined with one another.

Aspect 1. A coil support for supporting a coil header and managing a condensate, comprising a base having a principal surface elongated along a longitudinal axis from a first end to a second end and elongated along a lateral axis from a third end to a fourth end;

a sidewall extending away from the principal surface in the direction of the longitudinal axis;

a support feature that is provided on the base and/or the sidewall; and one or more openings that are configured to allow condensate to flow through the one or more openings.

Aspect 2. The coil support of aspect 1, wherein the sidewall extends outwardly from the principal surface of the base on one of the edges of the base.

Aspect 3. The coil support of aspect 1, wherein the base is generally rectangular in shape and has four edges, and the sidewall extends outwardly from the principal surface of the base along three of the four edges of the base.

Aspect 4. The coil support of aspect 1, wherein the sidewall is configured to surround the coil headers.

Aspect 5. The coil support of aspect 1, wherein the support feature is configured to provide support for the coil header.

Aspect 6. The coil support of aspect 5, wherein the support feature includes a shaped feature that has a cross-sectional shape as viewed in side view that follows at least in part an outline of a side cross sectional view of the coil header.

Aspect 7. The coil support of aspect 6, wherein the shaped feature is a crescent feature.

Aspect 8. The coil support of aspect 6, wherein the support feature includes more than one shaped feature, and the shaped features are placed in tandem.

Aspect 9. The coil support of aspect 1, wherein the support feature includes a central ledge that is configured to provide a predetermined space between the coil headers.

Aspect 10. The coil support of aspect 6, wherein more than one shaped feature is included in the support feature, and the shaped features have a shape that is similar to one another.

Aspect 11. The coil support of aspect 10, wherein the shaped features are placed in tandem so as to provide support for coil headers that are provided in tandem.

Aspect 12. The coil support of aspect 6, wherein the support feature includes a side ledge.

Aspect 13. The coil support of aspect 12, wherein support feature includes a sidewall, and the side ledge is configured to allow condensate to flow between the sidewall and the coil header when then coil header is provided in the shaped feature.

Aspect 14. The coil support of aspect 1, wherein the one or more openings are provided through the principal surface and/or the sidewall.

Aspect 15. The coil support of aspect 1, further comprising one or more mounting features.

Aspect 16. A coil assembly, comprising a support frame, a base plate that is attached to the support frame, the coil support in accordance with aspect 1 that is attached to the support frame and the base plate;

and a coil that include a coil header at each end of the coil, and is supported by the coil headers.

Aspect 17. The coil assembly of aspect 16, wherein the coil forms two rows, and the coil support is configured so as to allow condensate to flow between the rows.

Aspect 18. The coil assembly of aspect 16, wherein the support feature is configured to provide support for at least a portion of one of the coil headers.

Aspect 19. The coil assembly of aspect 16, wherein the coil support is dimensioned and/or is made of material so as to mitigate or prevent galvanic corrosion between the support frame and the coil.

Aspect 20. The coil assembly of aspect 16, wherein the coil assembly is an evaporator and/or a condenser coil assembly.

Aspect 21. A packaged unit, comprising the condenser coil assembly of aspect 16.

Aspect 22. A method of managing a condensate in the packaged unit of aspect 21, comprising draining condensate out of the coil support at a rate sufficient to prevent clogging of the openings and/or immersion of the coils in the condensate for an extended period of time.

With regard to the foregoing description, it is to be understood that changes may be made in detail, especially in matters of the construction materials employed and the shape, size and arrangement of the parts without departing from the scope of the present invention. It is intended that the specification and depicted embodiment to be considered exemplary only, with a true scope and spirit of the invention being indicated by the broad meaning of the claims.

What is claimed is:

1. A coil support for supporting coil headers and managing a condensate, comprising a base having a principal surface elongated along a longitudinal axis from a first end to a second end and elongated along a lateral axis from a third end to a fourth end;

a sidewall extending away from the principal surface;

a support feature that is provided on the base and/or the sidewall; and one or more openings that are configured to allow condensate to flow through the one or more openings, wherein the support feature includes two shaped features that are placed in tandem and a central ledge between the shaped features, and wherein each of the shaped features is a crescent feature and is configured to nest one of the coil headers.

2. The coil support of claim 1, wherein the sidewall extends outwardly from the principal surface of the base on one of the edges of the base.

3. The coil support of claim 1, wherein the base is generally rectangular in shape and has four edges, and the sidewall extends outwardly from the principal surface of the base along three of the four edges of the base.

4. The coil support of claim 1, wherein the sidewall is configured to surround the coil headers.

5. The coil support of claim 1, wherein the central ledge is configured to provide a predetermined space between the coil headers.

6. The coil support of claim 1, wherein the support feature includes a side ledge.

7. The coil support of claim 6, wherein support feature includes a sidewall, and the side ledge is configured to allow condensate to flow between the sidewall and the coil header when the coil header is provided in the shaped feature.

8. The coil support of claim 1, wherein the one or more openings are provided through the principal surface and/or the sidewall.

9. The coil support of claim 1, further comprising one or more mounting features.

10. The coil support of claim 1, wherein the coil support includes a plurality of support features.

11. The coil support of claim 1, wherein the coil support is formed from one mold such that the support feature is an integrated part of the coil support.

12. The coil support of claim 1, wherein the shaped features are placed in tandem so that a cross-sectional view as viewed in side view of the shaped features resembles a form of a "W" and so as to provide support for coil headers that are provided in tandem.

13. A coil assembly, comprising a support frame, a base plate that is attached to the support frame, the coil support in accordance with claim 1 that is attached to the support frame and the base plate;

and a coil that include a coil header at each end of the coil, and is supported by the coil headers.

14. The coil assembly of claim 13, wherein the coil forms two rows, and the coil support is configured so as to allow condensate to flow between the rows.

15. The coil assembly of claim 13, wherein the support feature is configured to provide support for at least a portion of one of the coil headers.

16. The coil assembly of claim 13, wherein the coil support is dimensioned and/or is made of material so as to mitigate or prevent galvanic corrosion between the support frame and the coil.

17. A packaged unit, comprising the condenser coil assembly of claim 13.

* * * * *